United States Patent [19]

Rooney et al.

[11] 4,308,515

[45] Dec. 29, 1981

[54] FUSE APPARATUS FOR HIGH ELECTRIC CURRENTS

[75] Inventors: William J. Rooney, Clifton; Francis J. Rooney, Ramsey, both of N.J.

[73] Assignee: Commercial Enclosed Fuse Co., Guttenberg, N.J.

[21] Appl. No.: 119,533

[22] Filed: Feb. 7, 1980

[51] Int. Cl.[3] ..... H01H 85/06

[52] U.S. Cl. ..... 337/162; 337/292; 337/293

[58] Field of Search ..... 337/158, 159, 161, 162, 337/290, 292, 293, 295

[56] References Cited

U.S. PATENT DOCUMENTS 3,296,399 1/1967 Kozacka ..... 337/162

3,418,614 12/1968 Krueger ..... 337/162 X 3,491,322 1/1970 Kozacka ..... 337/158 X

*Primary Examiner*—George Harris

*Attorney, Agent, or Firm*—Arthur L. Plevy

[57] ABSTRACT

A fuse for operation with both DC and AC currents is disclosed which consists of a composite fuse link contained in a large insulator housing. Located within the housing are first and second foil sections fabricated from a good conducting material. Each foil section is secured to a right and left terminal with its other end coupled to a central link fabricated from zinc. The central link is contained within a smaller cylinder and is surrounded by air, while the foil sections are surrounded by quartz sand or some other suitable filler material dispersed within the large housing.

15 Claims, 7 Drawing Figures

FUSE APPARATUS FOR HIGH ELECTRIC CURRENTS

BACKGROUND OF THE INVENTION

This invention relates to fuses and more particularly to a fuse configuration adapted to interrupt high currents and particularly adapted for use with large value AC or DC currents.

As is well known, there are many examples of fuses in the prior art. A fuse is basically a device which is normally applied in series with current to be monitored and if the current exceeds a predetermined value, the fuse will interrupt the current and hence, remove power from the circuit or system being monitored by the fuse. As indicated, there are many examples of fuses of various configurations which will serve to operate in conjunction with both AC or DC currents.

Basically, the problem of incorporating a fuse in a DC circuit exhibits many different requirements as compared to current interruption in an AC circuit. In this respect, many fuse manufacturers have two different types of fuses; one of which is intended for AC operation and the other intended for DC operation. As such, DC fuses in the prior art require a plurality of elements as fuse links which are connected in parallel and such fuses perform fairly well for major overload currents and so on. An AC fuse may be employed in a DC circuit, but one has to derate the fuse by as much as fifty percent.

In any event, one experiences substantial problems in interrupting high level DC currents. Amoung these problems are circuit interuption at moderate values of overload, creating gas pressures during arcing and the buildup of various deleterious substances during fuse operation, which substances tend to effect the overall performance of fuse operation. Such fuses must operate at small overload currents which may last for a prolonged period as well as operating with a high overload current which may exist for a shorter interval. The fuse must be compatible with all types of circuit loads such as inductive loads which may produce or provide excessive startup currents.

Many fuses in the prior art utilize a ribbon-type fuse link in conjunction with a rod upon which a portion of the fuse link is wrapped or directed. An example of a typical DC fuse found in the prior art may be had by referring to U.S. Pat. No. 3,935,553, entitled CARTRIDGE FUSE FOR DC CIRCUITS by Kozacka et al issued on Jan. 27, 1976.

Essentially, the fuse as above indicated has been employed for many years and various developments have been made in regard to superior materials and alternate configurations. For example, U.S. Pat. No. 3,940,728 entitled ALLOY FOR A HIGH TEMPERATURE FUSE issued on Feb. 24, 1976 to Komatsu et al depicts an alloy consisting of copper and aluminum and an additional metal such as nickel, maganese and iron and exhibits temperature operation within a range of 1,000° to 1,100° C. Such fuses are employed as temperature fuses but certain of these alloys may be used to interrupt electrical currents.

A number of patents such as U.S. Pat. No. 3,662,310 and U.S. Pat. No. 4,101,860 depict electrical fuses which operate in conjunction with a suitable filler such as quartz sand or employ housings fabricated from an inorganic ceramic material such as aluminum oxide, beryllium oxide, boron nitride, steatite, sullite and cordierite. The fuses which employ these housings also use a heat insulating arc quenching material such as quartz, sand or calcium sulphate. These materials serve to absorb heat under various temperature conditions and hence, by selection of the housing and the filler material as disclosed in the prior art patents, different operating characteristics can be provided for the fuse.

It is, of course, understood that a major component of any fuse is the fuse link which, as indicated by the prior art, comprises many different configurations; some of which are extremely difficult to fabricate and therefore are extremely expensive. Examples of certain prior art fuse links are depicted in U.S. Pat. No. 3,471,818 entitled UNITARY FULL RANGE CURRENT CLEARING FUSIBLE ELEMENT and U.S. Pat. No. 3,689,995 entitled ELECTRIC FUSES. Still other patents show alternate configurations for high current fuse operation employing various fuse link configurations as U.S. Pat. No. 2,376,809 entitled CIRCUIT INTERRUPTER.

It is therefore extremely desirable to provide a single fuse for both AC and DC operation; which fuse possesses the same current ratings for both modes of operation, while exhibiting reliable operation under DC conditions as well as AC conditions.

In view of the above, it is an object of this invention to provide reliable and improved fuse apparatus which is capable of operating to interrupt high level AC or DC currents and will respond to both large overloads and small overloads. The apparatus employed is easy to fabricate in employing conventional materials in a unique arrangement.

BRIEF DESCRIPTION OF THE PREFERRED EMBODIMENT

A fuse apparatus comprising a tubular casing of an electric insulating material, a pair of terminal elements closing the ends of said casing, a composite fuse link disposed within said casing and interconnecting said terminal elements, said fuse link comprising a first ribbon-like fuse link section fabricated from a good conductor having a first end coupled to one of said terminals and a second end directed towards said other terminal, a second ribbon-like fuse link section fabricated from a good conductor having a first end coupled to said other terminal and a second end directed towards said second end of said first link, a third fuse link section fabricated from a different conductor than said first or second and coupled between said second ends of said first and second link sections, arc quenching filler means located within said casing and surrounding and in contact with only said first and second link sections, whereby said third link is not contacted by said filler means to cause heat generated by said first and second link sections during fuse operation to thermally propagate to said third link section.

DETAILED DESCRIPTION OF THE INVENTION

Figure 1:
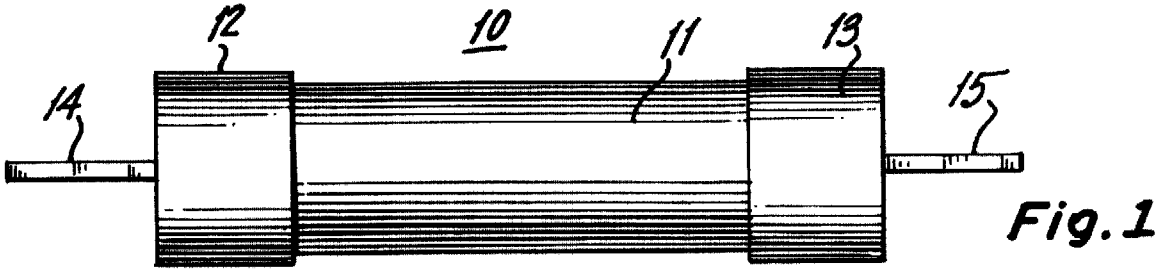
FIG. 1 is a side view of a typical cartridge fuse assembly.

Referring to FIG. 1, there is shown a typical high current fuse 10. Essentially, a fuse configuration as shown in FIG. 1 is relatively conventional in appearance and is sometimes referred to as a cartridge fuse. The fuse is generally of a cylindrical configuration with a main body 11 fabricated from a heat resistant insulating material such as a vulcanized fiber or cellulose material.

Located at each end of the fuse are brass plated steel caps 12 and 13. Copper terminals 14 and 15 are shown protruding from each end and are used to place the fuse in circuit. Essentially, the copper terminals 14 and 15 are planar copper sheets fabricated from a relatively thick copper stock and are directed through the caps 12 and 13 by apertures or slots located in the caps.

It is also known to provide a cartridge fuse as 10 without terminals as 14 and 15. In this configuration, the caps 12 and 13 are used to emplace the fuse in circuit and hence, the copper terminals 14 and 15 are eliminated. The generally external configuration for such cartridge fuses 10 as shown in FIG. 1 is well known and relatively conventional.

In any event, as described above, there is an extreme problem in the prior art in obtaining a fuse with a given rating, which rating is applicable for both DC and AC operation.

Figure 2:
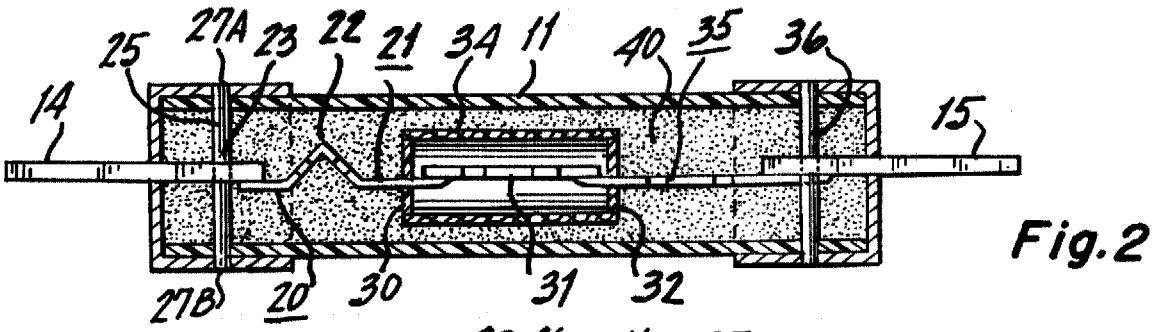
FIG. 2 is a partial cross sectional side view showing a fuse link assembly according to this invention.

FIG. 2 shows a partial cross sectional view of a fuse and link arrangement according to this invention and which arrangements are contained in a housing configuration as shown in FIG. 1. The reference numeral 11 again refers to the cylindrical outer container fabricated from a suitable insulating material. Located within the internal hollow of the cylinder 11 is a fuse link 20 which, as will be described, is a composite arrangement consisting of a first conductive link 21 which is fabricated from a thin foil of copper, silver or some other highly conductive metal.

There is an angular "V" shaped bend 22 in the conductive foil 21. The bend is used to allow the link to expand and contract during operation based on generation of heat when the fuse is conducting current. Such flexures or bends of many configurations are known in the fuse art.

One end of the conductive link 21 is coupled to the copper terminal plate 14 by means of two rivets as 23 which are formed from the copper plate 14 by an extrusion process. The heads of the rivets are located within apertures in the link 21 and may be soldered permanently in place.

The terminal 14 as well as the link 21 has a corresponding central aperture through which a post 25 is located. The post 25 is fabricated from a suitable steel and essentially supports the fuse link within the outer casing 11. The support post 25 is inserted into apertures 27A and 27B located in the wall of the casing 11. This configuration will be shown in greater detail in other figures.

The conductive link 21 has one end directed through a circular washer 30 to a relatively central link 31. The link 31, as will be explained, is fabricated from zinc or a zinc alloy and is primarily responsive to DC operation of the fuse. The link 31 is soldered to the link 21 by means of a spot weld in conjunction with a suitable solder foil.

The link 31 is located within a cylindrical container formed by washer 30 and washer 32 at each end and surrounded by an outer cover layer of insulating material 34 such as Kraft paper. The zinc link 31 as located within the container is surrounded by air as will be described.

Coupled to the other side of the link 31 is an additional copper link 35. Link 35 is fabricated from the same material such as copper or silver as is link 21 and is soldered to link 31 in the same manner as described above. The link 35 is secured to terminal 15 by the rivet configuration described above and the assembly is again supported by post 36 in the manner above described.

In high current fuses, a filler material such as quartz sand is used to surround the fuse link. This material 40 basically operates as an arc quenching material and quartz sand and similar materials have been employed as fuse fillers in many prior art fuses.

As can be seen from FIG. 2, the cylinder surrounding the zinc link 31 prevents any sand from entering the internal confines of the cylinder and hence, the zinc link 31 is surrounded by air, while ribbons 21 and 35 or the copper or silver links are completely surrounded by sand.

Figure 3:
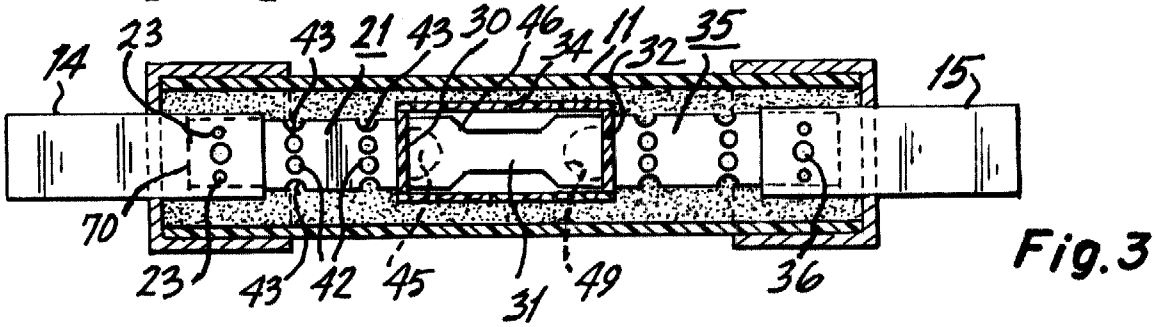
FIG. 3 is a partial cross sectional top view of the fuse assembly of FIG. 2.

Referring to FIG. 3, there is shown a top view of the link assembly just described with the reference numerals depicting the equivalent structure. As can be seen from FIG. 3, terminals 14 and 15 are planar members of copper or some other suitable conductive material. The first fuse link section 21 consists of a conductive planar foil and has apertures as 42 located on the surface thereof. The apertures 42 essentially serve to reduce the cross section of the metal foil material 21. The reduction in the cross section constitutes a weakening of the fuse link 21 at that point and essentially, the metal located between the apertures is more prone to melt and hence, cause current interruption during fuse operation. The use of such apertures to provide a reduction in cross section is also employed in many fuse representations. in any event, it is noted that apertures 42 are circular in shape.

Viewing FIG. 3, there are shown partial apertures as 43 at the top and bottom edges of the foil. These apertures constitute approximately two thirds of a complete circle. The tips which abutt each other act as an arc gap which enables voltage arcs to jump across the tips and hence, these apertures uniquely operate to broaden the voltage arc during fuse operation and to prevent the arc or restrain the arc from running up or along the edge of the link.

Referring to FIG. 3, the end of the link 21 is formed into a tab 45. The tab is inserted through an aperture in the washer 30 and the tab 45 is then spot welded to the zinc link 31 as described above. The washer 30 is also fabricated from a relatively similar material to that used for the casing 11 and hence, may also be a vulcanized fiber material.

As seen from FIG. 3, the zinc link 31 has a reduced central area with extended right and left areas. The configuration shown for the link 31 permits reliable DC operation, while the angled portion as 46 serves to prevent arcing.

The link 35, as indicated, is also secured to the link 31 by the tab 49 which is inserted into the central aperture of washer 32. As indicated, the washers 30 and 32 form the front and back surfaces for the air filled cylinder containing the zinc element 31. The surface of the cylinder is formed by a sheet of Kraft paper 34 which is glued or otherwise secured to washers 30 and 32 by a suitable high temperature epoxy or glue.

Also shown in FIG. 3 is the central aperture through which post 25 is inserted and the rivets as 23 which operate to secure the foil links 21 and 35 to the terminal plates 14 and 15.

Figure 4:
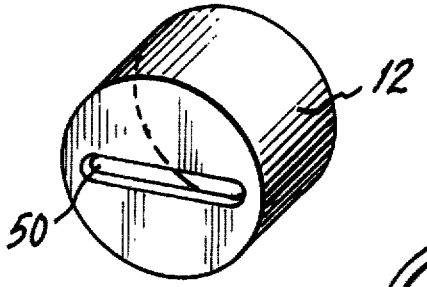
FIG. 4 is a perspective view of a fuse end cap.

Essentially, the entire link structure as shown in FIG. 3 including terminals 14 and 15 are fabricated and assembled. The structure is then inserted into the casing 11. The posts 25 and 36 are then directed through the apertures in the casing 11 to secure the entire assembly in the position shown in FIGS. 2 and 3. The unit may then be filled with quartz sand to surround the links 21 and 35, with the link 31 as contained within the cylinder being surrounding by air. Prior to filling with sand, the posts 25 and 36 are positioned within the apertures in the casing 11 to hold the fuse link assembly in place. The end caps such as 12 and 13 are then placed over each end. As shown in FIG. 4, each end cap as 12 or 13 has a central slot 50 which is dimensioned to accommodate the copper terminals 14 and 15.

Figure 5:
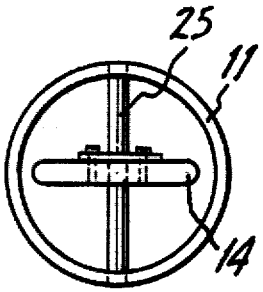
FIG. 5 is a front view of a fuse structure according to this invention.

FIG. 5 shows an end view of the fuse configuration depicted in FIG. 3 and shows the support post 25 located within suitable apertures in the wall of the casing 11.

Figure 6:
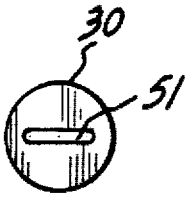
FIG. 6 is a front plan view of an insulator washer used to form a top surface of a cylinder to surround a portion of the fuse link.

FIG. 6 shows a front view of a washer as 30 and 32 together with the central slot 51 for accommodating the tabs as 45 and 49 associated with the conductive link portions 21 and 35.

Figure 7:
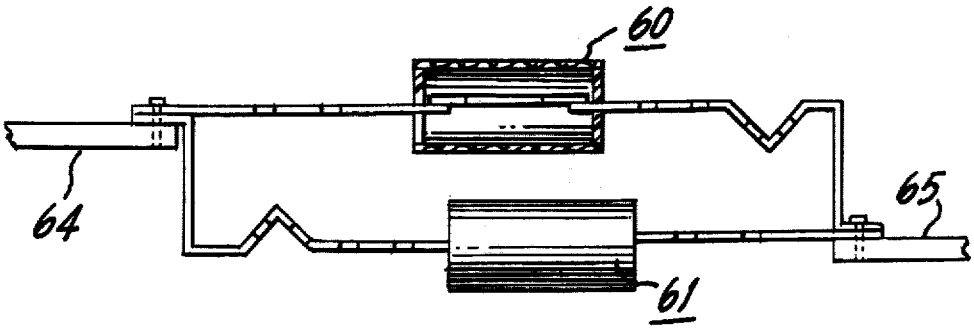
FIG. 7 is a schematic side view of parallel fuse link configurations according to this invention.

FIG. 7 depicts a parallel combination of a first composite fuse link 60 in parallel with a second composite fuse link 61, each of which has a configuration as shown in FIG. 2, for example. In this manner, the terminals 64 and 65 correspond to terminals 14 and 15, but there are two distinct composite link assemblies as 60 and 61 which are contained in one casing as 11. By using parallel combinations, one can, of course, achieve higher current operation and also provide different operating characteristics in regard to response time as one path may break or interrupt conduction prior to the other path.

In any event, with the above noted structure in mind, a few comments concerning the operation provided by this fuse are warranted. As indicated, most present fuse manufacturers supply a separate line of fuses for AC operation and a separate line of fuses for DC operation. The fuse described above will operate equally well at the same ratings for both AC and DC operation. Essentially, the operation of the fuse is as follows:

For DC conditions, the zinc link 31 has excellent properties in quenching DC arcs which may be provided by inductive loads coupled in circuit with the fuse. In any event, the zinc link 31 is surrounded by air, which air acts as an insulator. Zinc, when operating as a fuse link, has a higher resistance than copper or silver and hence, produces heat. If the circuit were surrounded by sand, it would react with the sand to produce a zinc glass compound which will, in fact, conduct current and hence, adversely effect fuse operation.

In the fuse configuration shown in the above FIGURES, on a low overload condition, the zinc link 31 immediately melts. For high overload conditions, the ribbon link as 21 or 35 will open. Hence, the use of the zinc link 31 as surrounded by air permits the fuse to respond to low DC overloads at current levels at which the copper links will not respond.

Copper or silver which comprise the link sections 21 and 35 respond very well to short circuit conditions and hence, for a short circuit condition, whether it be DC or AC, the copper or silver works fairly well. In any event, for large overload currents or short circuit conditions the heat produced by the copper reacts with the sand to produce a semiconducting glass, which glass actually permits conduction from terminals 14 and 15 to futhur help quench the arc.

Under such conditions, the heat produced in the sand or the formed glass is transferred to the zinc link 31 by conduction and the zinc link will therefore interrupt current operation under these conditions. In this manner, one is always sure that during any overload, the zinc link 31 will open the fuse. During large overloads, the copper or silver links as 21 or 35 will operate as the major current interupters with the link 31 as the backup.

Essentially, AC operation is equivalent to the DC operation just described and hence, the fuse will operate to interrupt both AC and DC currents for both short circuit conditions or small prolonged overload conditions.

Zinc, as indicated, has the unique ability to respond to DC arcs and to quench such arcs. In this manner, any heat transferred from the copper links during a short or prolonged overload will be conducted to the zinc link via the air contained within the cylinder and will cause the link 31 to open, thus interrupting current flow between terminals 14 and 15. The zinc link 31 is sufficiently thick as compared to the thickness of the foil links 21 and 35 so that the zinc link 31 will not operate during short circuit conditions and hence, these conditions are handled by the links 21 and 35.

A typical fuse such as shown in the above figures may be used to interrupt both AC and DC currents in excess of one hundred amps and approximately employ the following dimensions: The copper terminals as 14 and 15 are approximately 1½" long, 0.125" thick and approximately 0.74" wide. The metal foil sections as 21 and 35 were fabricated from copper foil approximately 0.015" thick. The "V" bend had an apex angle of approximately 45°. The length of the foil element 21 from edge 70 to the end of the tab 45 was approximately 1.3". The length of the foil member 35 was approximately 1.2". The zinc link 31 was fabricated from pure zinc or a zinc alloy of approximately 0.028" in thickness. The center portion was approximately 0.190" with the right and left ends being approximately 0.510". The length of the link 31 was approximately 1.28". The washers 30 and 32 are approximately 0.07" wide and 0.6" in diameter. The apertures as 42 were approximately 0.012" in diameter.

As indicated, a fuse with the above noted dimensions is sufficient to operate with DC and AC currents in the vicinity of one hundred amps. Fuse configurations such as shown in FIG. 7 using similar dimensions for each section such as 60 and 61 will operate with a current capacity of two hundred amps.

It will also be understood by those skilled in the art that various other configurations, for example, by using different materials for sections 21 and 35 including different aperture configurations as 42 and different diameters and different spacings, one can accommodate a wide variety of current operation for both AC and DC and it is known by those skilled in the art on how to vary the materials and such dimensions in order to afford a diversity of fuse operation.

It is again stressed that a main advantage of the above described fuse is its ability to operate at the same rating with both AC and DC current. The ability is enhanced by providing a composite fuse link which consists of a first and a second foil section fabricated from a good conductor such as copper or silver and which sections are spot welded or otherwise secured to a zinc link which provides optimum operation under DC conditions. The zinc link is surrounded by an insulator cylinder and hence, operates within the hollow confines of the cylinder surrounded by air. The copper links are in turn disposed and surrounded by quartz sand or some other suitable filler used in high current fuses. The composite configuration is extremely versatile and can be used to fabricate various fuse configurations with wide and diverse ratings for both AC and DC operation.

We claim:

1. A fast acting fuse apparatus capable of operating with both AC and DC current at the same rating, comprising:

(a) a tubular casing of an electric insulating material, (b) a pair of terminal elements closing the ends of said casing, (c) a composite fuse link disposed within said casing and interconnecting said terminal elements, said fuse link comprising a first ribbon-like fuse link section fabricated from a good conductor having a first end coupled to one of said terminals and a second end directed towards said other terminal, a second ribbon-like fuse link section fabricated from a good conductor having a first end coupled to said other terminals and a second end directed towards said second end of said first link, a third fuse link section being a planar member fabricated from a different conductor of a material having a higher resistance than said first or second links and coupled between said second ends of said first and second link sections, (d) arc quenching filler means located within said casing and surrounding and in contact with only said first and second link sections, whereby said third link is not contacted by said filler means to cause heat generated by said first and second link sections during fuse operation to thermally propagate to said third link section, whereby during large current overloads said first and second links open to interrupt current flow for both AC and DC and for low overloads said third link will open to enable said fuse to respond to both AC and DC currents with the same ratings.

2. The fuse apparatus according to claim 1 further including a tubular cylindrical member enclosing said third link section with top and bottom closed surfaces, and means located on said surfaces for connecting said enclosed third link to said second ends of said first and second links, with said member preventing said filler from surrounding said third link.

3. The fuse apparatus according to claim 1 wherein said first and second links are fabricated from thin ribbon-like sheets of a conductive material selected from silver or copper, having spaced apertures on the surface thereof for providing weak spots.

4. The fuse apparatus according to claim 3 wherein said third link is fabricated from zinc.

5. The fuse apparatus according to claim 1 wherein said third link is thicker than said first or second links.

6. The fuse apparatus accordin to claim 1 wherein said tubular casing is fabricated from a vulcanized fiber.

7. The fuse apparatus according to claim 2 wherein said tubular cylindrical member is fabricated from Kraft paper, with said top and bottom surfaces fabricated from a vulcanized fiber.

8. The fuse apparatus according to claim 1 wherein said first and second links have partial apertures located along each edge, with the partial ends of said apertures providing an arc conducting path.

9. The fuse apparatus according to claim 1 wherein said first link has a surface bend to permit expansion and contraction of said composite link during operation.

10. In a fuse apparatus of the type employing a tubular outer casing with a first and second terminal interconnected by a fuse link operative to open when the current through said fuse as flowing between said terminals exceeds a predetermined value, the combination therewith of a composite fuse link capable of providing operation with both AC and DC current at the same rating, comprising:

(a) a first thin planar fuse link member located in said casing and fabricated from a good conductive material having one end connected to said first terminal and said other end directed towards the center of said casing, (b) a second thin planar fuse link member located in said casing and fabricated from a good conductive material having one end connected to said second terminal and said other end directed towards the center of said casing, (c) a third fuse link member being a planar member and fabricated from a different conductive material having a higher resistance than said first or second links and coupled between said other ends of said first and second links, (d) means surrounding said third fuse link to provide an enclosure for the same to cause said third link to be surrounded by the atmosphere within said enclosure, (e) arc quenching filler means located in said casing and disposed about said first and second links, whereby during large current overloads said first and second links will open to interrupt current flow for both AC & DC and for low overloads said third links will open to enable said fuse to respond to both AC & DC currents at the same ratings.

11. The fuse apparatus according to claim 10 wherein said first and second links are fabricated from a material selected from copper or silver.

12. The fuse apparatus according to claim 10 wherein said third link is fabricated mainly from zinc.

13. The fuse apparatus according to claim 10 wherein said means surrounding said third link comprises an insulative tubular cylinder.

14. The fuse apparatus according to claim 10 wherein said arc quenching filler means comprises quartz sand.

15. The fuse apparatus according to claim 10 wherein said first and second thin planar fuse link members each have on a surface thereof, a plurality of apertures manifesting "weak spots" for said fuse link, with partial apertures along the edges of said members constituting arc gaps.

* * * * *